US007392960B2

(12) United States Patent
McNeil et al.

(10) Patent No.: US 7,392,960 B2
(45) Date of Patent: Jul. 1, 2008

(54) METHOD FOR UNWINDING ROLLS OF WEB MATERIAL

(75) Inventors: Kevin Benson McNeil, Loveland, OH (US); Thomas Timothy Byrne, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 78 days.

(21) Appl. No.: 10/280,782

(22) Filed: Oct. 25, 2002

(65) Prior Publication Data

US 2004/0079830 A1 Apr. 29, 2004

(51) Int. Cl.
*B65H 23/06* (2006.01)

(52) U.S. Cl. ..... 242/420.6; 242/563

(58) Field of Classification Search ..... 242/420.6, 242/420.3, 563, 615.2, 615.21
See application file for complete search history.

(56) References Cited

U.S. PATENT DOCUMENTS

| | | | | |
|---|---|---|---|---|
| 3,381,913 | A | | 5/1968 | Bachman |
| 3,694,928 | A | | 10/1972 | Barta et al. |
| 4,304,370 | A | | 12/1981 | Box et al. |
| 4,505,699 | A | | 3/1985 | Totani |
| 4,582,271 | A | * | 4/1986 | Takahashi ..... 242/420.6 |
| 4,590,746 | A | * | 5/1986 | Humphrey ..... 242/420.6 |
| 4,693,433 | A | | 9/1987 | Martin |
| 4,848,694 | A | * | 7/1989 | Julian ..... 242/420.6 |
| 4,979,692 | A | | 12/1990 | Julian |
| 5,005,335 | A | | 4/1991 | Yourgalite et al. |
| 5,097,688 | A | | 3/1992 | Taylor et al. |
| 5,123,607 | A | * | 6/1992 | Jones ..... 242/420.6 |
| 5,315,461 | A | * | 5/1994 | Todd ..... 242/615.21 |
| 5,417,783 | A | | 5/1995 | Boreali et al. |
| 5,451,011 | A | | 9/1995 | Frost |
| 5,464,143 | A | * | 11/1995 | Hansen ..... 242/615.21 |
| 5,480,085 | A | * | 1/1996 | Smithe et al. |
| 5,573,231 | A | * | 11/1996 | Stab ..... 242/615.21 |
| 5,730,389 | A | | 3/1998 | Biagiotti |
| 5,803,393 | A | * | 9/1998 | Julian ..... 242/420.6 |
| 5,842,664 | A | | 12/1998 | Akerlund |
| 5,887,816 | A | | 3/1999 | Jones |
| 5,906,333 | A | | 5/1999 | Fortuna et al. |
| 5,908,169 | A | | 6/1999 | Brinkmeier |
| 5,934,604 | A | | 8/1999 | Klimek |
| 6,030,496 | A | | 2/2000 | Baggot et al. |
| 6,051,095 | A | | 4/2000 | Butterworth |

(Continued)

FOREIGN PATENT DOCUMENTS

| | | |
|---|---|---|
| DE | 29 48 662 A1 | 6/1981 |

(Continued)

*Primary Examiner*—William A. Rivera
(74) *Attorney, Agent, or Firm*—Peter D. Meyer; David K. Mattheis; Betty J. Zea

(57) ABSTRACT

A method and apparatus for unwinding a vertically oriented roll of web material is disclosed. The roll comprises a lower surface, an upper surface and a circumferential surface. The apparatus comprises: at least one drive element adapted to rotate the vertically oriented roll, a sensor adapted to measure a tension of the web, and a controller adapted to adjust a speed of the web according to the tension of the web. The method comprises steps of rotating the roll, determining a desired web tension, and adjusting the speed of the roll according to the desired web tension.

13 Claims, 4 Drawing Sheets

U.S. PATENT DOCUMENTS

| | | | |
|---|---|---|---|
| 6,119,971 | A | 9/2000 | Jones |
| 6,595,454 | B2 * | 7/2003 | Roba et al. |
| 6,824,032 | B2 * | 11/2004 | Kumatori |

FOREIGN PATENT DOCUMENTS

| | | | |
|---|---|---|---|
| DE | 197 11 509 | C1 | 10/1998 |
| EP | 0 648 699 | A1 | 4/1995 |
| WO | WO 01/64559 | A2 | 9/2001 |
| WO | WO 01/64562 | A2 | 9/2001 |

* cited by examiner

METHOD FOR UNWINDING ROLLS OF WEB MATERIAL

FIELD OF THE INVENTION

This invention relates to the handling of web materials. The invention relates particularly to the unwinding of rolls of web materials.

BACKGROUND

In the manufacturing of web materials, large rolls of the material are produced. These large rolls are subsequently processed to produce a finished product. The conversion of the roll to a finished or intermediate product requires the transport and unwinding of the roll of web material.

Web-converting processes include a roll unwinding apparatus configured to unwind a horizontally oriented roll to present the web to the converting equipment in a horizontal orientation. A horizontal roll may be core driven; it may be compressed along the longitudinal axis and driven on the end surfaces of roll. The roll may also be driven using belts in contact with the outer surface of the roll. Low-density rolls may be adversely affected by being surface driven. For example, a 250 cm. diameter roll that is 255 cm wide and weighs 1600 kg, may be supported by 5 belts each 15 cm. wide over a circumference arc of 100 cm. This drive produces a compressive force in the supported areas of 20,700 N/m$^2$. These compressive forces can alter the tissue web's unwinding speed, distort the webs, and lower the quality of the finished products made from the webs.

Horizontal rolls may acquire an egg-shaped cross section rather than the desired round cross section. 15 to 20 cm. eccentricity is common in rolls having a diameter of 250 cm. Unwinding an egg shaped roll is problematic in that the mass of the roll is not balanced about the longitudinal axis. This imbalance results in additional strain on the unwinding mechanism as the forces generated by the rotating roll fluctuate with the unbalanced mass. These forces are directly proportional to the degree of imbalance present in the roll and the speed of rotation of the roll. Severely unbalanced rolls must therefore be unwound slowly to avoid subjecting the unwinding apparatus to destructive forces. Furthermore, the unwinding of the unbalanced roll can cause the speed and tension of the web to fluctuate considerably. These speed and tension fluctuations can result in web breaks and lost production time. Again the affect of the unbalanced roll is more severe at higher speeds so again the unwind speed must be slowed to reduce the incidence of web breaks. The rate at which an unbalanced roll may be reliably unwound limits the rate of the downstream process. The fluctuations in web speed and tension can affect the quality and uniformity of the converted product.

The fluctuations in the web speed and tension also impair the ability of the web processor to splice multiple rolls of material without stopping the unwinding process or without extensive capital investment in splicing equipment to enable a flying splice despite the fluctuations in tension and speed. Splicing methods known in the art require the webs to have matched speeds at the time of splicing. The inability to maintain a consistent web speed thus requires stopping the web and in some instances the entire process to splice rolls together resulting in lost production time.

After a stoppage, the production equipment must be accelerated back to production speeds during which time more productivity is lost. Then the spliced portion of the web must be removed from the finished product. Due to the fluctuations in speed before and after the splice it is often necessary to remove a substantial amount of product to ensure that the spliced portion is removed. This results in high material losses.

This invention provides a method and apparatus for unwinding a roll of a web material that will enable high speed unwinding of the web while maintaining narrow limits on the fluctuations in the speed and tension of the web.

This invention further provides a method and apparatus for unwinding a web that includes a reliable means of splicing multiple webs without stopping the unwinding process.

SUMMARY OF THE INVENTION

This invention provides an apparatus and method for unwinding a roll of web material. The axis of the roll is vertically oriented while the roll is being unwound. In one embodiment, the method comprises steps of: rotating the vertically oriented roll of web material; determining a desired web tension; and adjusting the speed of the web according to the desired web tension. This method may be performed on an apparatus comprising a drive element configured to rotate a vertically oriented roll of web material; a sensor adapted to measure the tension of the web; and a controller adapted to adjust the speed of the web according to the web tension.

In another embodiment, the method comprises steps of rotating the vertically oriented roll; determining a desired speed for the web; and adjusting the speed of the web according to the desired speed of the web. This embodiment may be performed on an apparatus comprising a drive element configured to rotate a vertically oriented roll of web material; a sensor adapted to measure the speed of the web; and a controller adapted to adjust the speed of the web according to the desired web speed.

In another embodiment, the method comprises steps of determining a desired tension and a desired speed and adjusting the speed of the web according to the desired tension and /or the desired speed.

In still another embodiment the method comprises steps of: partially unwinding a first vertically oriented roll; preparing a second web from a second vertically oriented roll; rotating the second roll according to the speed of the first web; contacting the second web with the first web; and separating the remainder of the first web from the unwound portion of the web.

DEFINITION

Fabric side: the side of a wet laid web in contact with the drying fabric of the web making machinery during the web making process.

Roll: cylinder of web material wound about a longitudinal axis, having a cylindrical circumferential surface, and two end surfaces. A vertically oriented roll has a lower end surface, an upper end surface and a circumferential surface.

Web material: any material having dimension in two orthogonal directions that are much greater than the dimension in a third orthogonal direction.

Unwind station: equipment adapted for rotating a roll of web material in a direction angularly opposed to the direction in which the web is wound about the longitudinal axis of the roll.

Vertically oriented: oriented substantially perpendicular to the plane of the horizon. By substantially perpendicular it is meant that the vertically oriented object is close enough to perpendicular to the horizon so as to act as an object that is perpendicular to the horizon.

Wire side: that side of a wet laid web in contact with the forming wire of the web making machinery. The forming wire is that portion of a web-making machine upon which the slurry of web-making fiber is initially deposited during the web-making process.

DETAILED DESCRIPTION OF THE INVENTION

Figure 1:
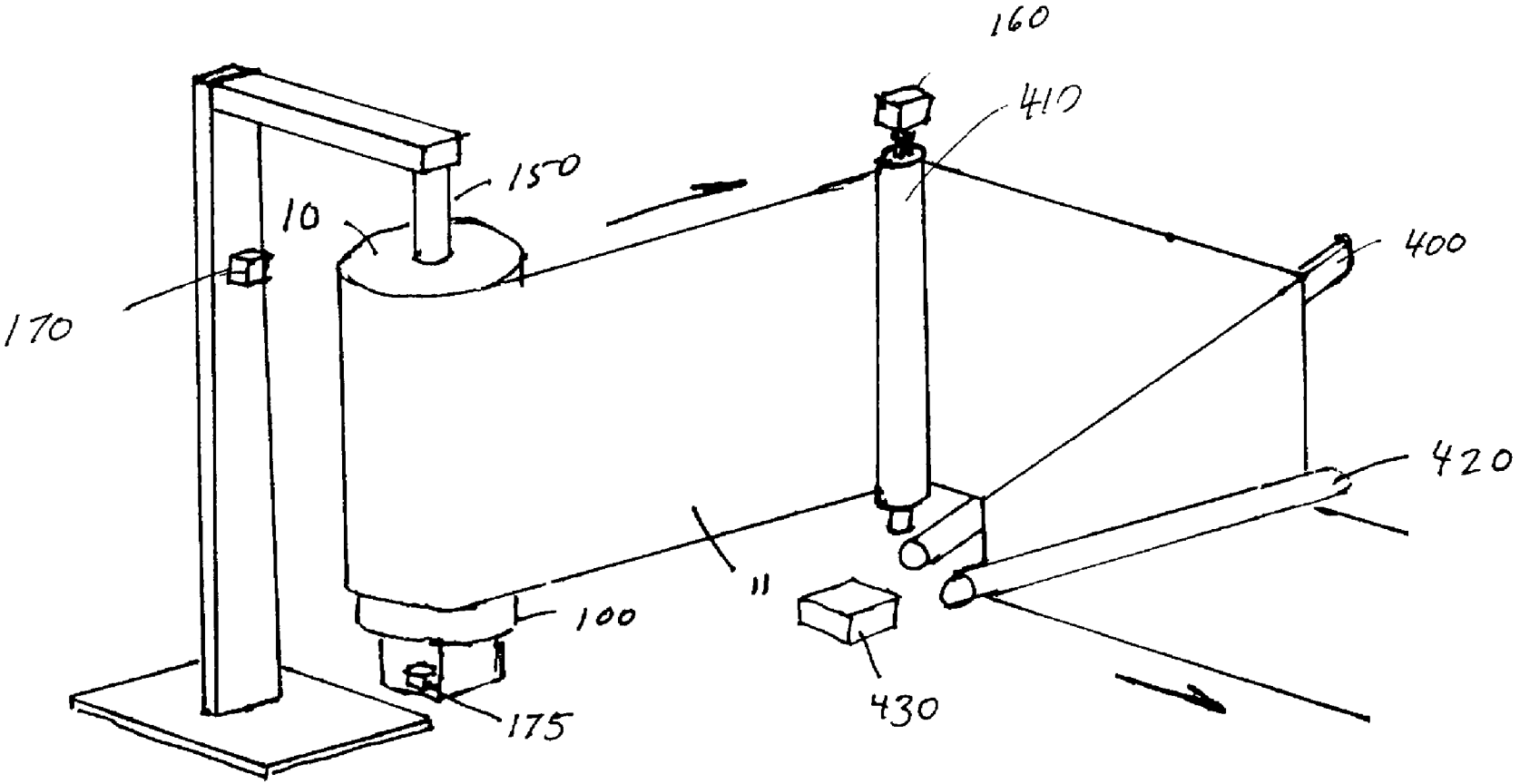
FIG. 1 schematically shows an unwind apparatus according to the present invention FIG. 2 schematically shows a cross section of an unwind station according to the present invention.

FIG. 1 illustrates the apparatus adapted to perform the method of the present invention. Rotating drive element 100, contacts and rotates roll 10, thereby unwinding the web 11. The web 11 may be supported by at least one web support element 410. The tension in the web 11 is sensed by tension sensor 160. A controller (not shown) calculates the web tension error as the difference between the sensed web tension and a desired web tension. The controller then adjusts the speed of the web 11 to reduce the web tension error to zero.

In another embodiment, the apparatus comprises a diameter sensor 170, to measure the diameter of the roll 10. The diameter sensor 170 may comprise a contacting element that maintains contact with the outer edge of the roll 10, as the roll is unwound. The position of the contacting element is then sensed and used to determine the diameter of the roll 10. Alternatively, the diameter sensor 170 may be fixed and may utilize a non-contacting means to determine the position of the edge of the roll 10. Non-limiting examples of the diameter sensing means include ultrasonic pulses, non-coherent electromagnetic beams or pulses, or laser beams or pulses. A Hyde Park SUPERPROX SM556A-400LE available from Hyde Park Electronics Inc., Dayton, Ohio, is an exemplary sensor for determining the roll 10 diameter.

The apparatus may comprise a rotation sensor 175 to determine the speed of rotation of the roll 10. The speed of rotation of the roll 10 may be determined by means of a speed resolver, tachometer, or other means as are known in the art. An exemplary sensor for determining roll rotation speed is an Allen Bradley 845H encoder available from Rockwell Automation, Milwaukee, Wis.

The apparatus and method of the present invention may be used to unwind any type of web material 11 from any size roll 10. The method is particularly useful for unwinding large rolls 10 of high bulk, low density (<10 g/cm$^3$) tissue paper. Rolls are wound about a longitudinal axis. The roll 10 may be wound around a core 13, coincident with the longitudinal axis, or may be coreless.

Rolls 10 are generally wound with the axis of the roll 10 horizontal, (parallel to the plane of the horizon). The winding axes of the rolls 10 unwound by the method of the invention are vertically oriented. This axis orientation can be accomplished by upending equipment or other means as is known in the art. Upending refers to the reorientation of a roll 10 of material from a position wherein the longitudinal axis of the roll 10 is horizontal to a position wherein the longitudinal axis is substantially vertical.

The dimensions of the roll 10 are not critical to the practice of the invention. The apparatus and method may be used to unwind rolls 10 having widths and diameters of only a few centimeters. Alternatively, the method and apparatus may be used to unwind rolls 10 having dimensions of several meters. The method and apparatus of the invention are particularly useful for the unwinding of rolls 10 of web material having a width and diameter of about 250 centimeters. Applicants believe that the method and apparatus of the invention may unwind rolls of any diameter that may be manufactured.

The apparatus comprises at least one drive element 100 adapted to contact and rotate the roll 10 of web material 11. The drive element 100 may contact any surface of the roll 10. The drive element 100 may contact at least a portion of: the lower surface of the roll 10, the upper surface of the roll 10, the circumferential surface of the roll 10, or the inner surface of the core 13 of the roll 10. Embodiments where multiple drive elements 100 are used and contact at least portions of multiple surfaces of the roll 10 are also possible.

Vertically oriented rolls have a characteristic telescoping force, and a core slippage force. The telescoping force is the force that must be overcome to cause the windings of the roll 10 to slip past one another as the tubes of a multiple tube telescope slip past each other. The core slippage force is the force that must be overcome to cause the innermost windings of the roll 10 to slip relative to the core 13. A roll 10 is considered telescoping if the force of gravity is sufficient to overcome the telescoping force of the roll 10. Similarly, a roll 10 is considered non-telescoping if the force of gravity is not sufficient to overcome the telescoping force of the roll 10. The lower surface of a telescoping roll 10 typically needs to be completely supported while the lower surface of a non-telescoping roll 10 does not need complete support.

The apparatus for non-telescoping rolls may comprise a core support element 120 as part of the drive element 100. The core support element 120 may be expanded radially after being inserted into the roll core 13. This expansion couples the mass of the roll 10 to the drive element 100. The drive element 100 may then rotate the roll 10 by applying torque to the core support element 120. The torque may be applied by any means known in the art. As non-limiting examples, the core support element 120 may be belt driven; chain driven; gear driven; or direct driven. The core support element 120 may extend completely through the roll core 13, or alternatively, only a portion of the way through the core 13.

In one embodiment the apparatus includes a stabilizing element 150 adapted to stabilize the upper end of the roll 10 that is vertically oriented. For unwinding rolls 10 wound on a core 13, the stabilizing element 150 is adapted to engage the core 13 during unwinding and then to move out of the way when the core 13 is being removed and a subsequent roll 10 is being placed on the unwind station. As a non-limiting example, an overhead gantry system with the capability of moving the stabilizing element 150 in mutually orthogonal x-y and z directions may be utilized. Alternatively, the stabilizing element 150 may be capable of movement in only the z direction. In this embodiment the stabilizing element 150 moves down to engage and stabilize the core 13. The stabilizing element 150 moves up to free the core 13 when removal of the core 13 is desired. The stabilizing element 150 may also be configured to move along a path from a disengaged position out of contact with the core 13 to an engaged position in contact with the core 13. A pneumatic chuck, a rotating eccentric chuck, or any otherwise radially expanding device may be used to positively engage the core 13 of the roll 10.

The stabilizing element 150 may be adapted to contact a portion of the upper surface of the roll 10. The stabilizing element 150 may be used alone or in conjunction with an upper core stabilizer as described above. The stabilizing element 150 may also be powered and function as a drive element in addition to stabilizing the roll 10.

Reorientation:

FIG. 1 illustrates the apparatus for reorienting the plane of the web 11 from vertical to horizontal. As the web 11 unwinds and is routed toward a downstream process, it may be advantageous to reorient the web 11 from a vertical to a horizontal plane. This reorientation may be accomplished by routing the path of the web 11 around an angled web turning element 400. The web 11 is then routed around a second web turning element 420 having a horizontal axis and the resultant plane of the web 11 will also be horizontal.

The first turning element 400 and second turning element 420 may be rolling elements capable of rotating with the web 11 as the web passes around the turning elements. Either, or both, of the turning elements 400, 420 may be driven elements capable of imparting power to the web 11. As a non-limiting example, the rolling web turning elements 400, 420 may be comprised of carbon fiber spans, and hubs supported by rolling element bearings.

The rolling resistance of the turning elements 400, 420 should be minimized to reduce the drag forces on the moving web 11. Excessive drag forces may damage or break the web 11. The inertia of the turning elements 400, 420 should also be minimized to reduce the extent to which the turning elements continue to turn after the web 11 has stopped. The continued movement of the turning elements 400, 420 after the web 11 has stopped may also damage or break the web 11.

The speed of driven turning elements 400, 420 should be controlled to impart no more drag force to the web 11 than the desired level. The speed should also be controlled as the web 11 starts and stops to reduce the relative motion between the web 11 and the turning elements 400, 420.

The turning elements 400, 420 may be grooved rollers. Grooved rollers may be one way ascending—the grooves angled up in the direction of web travel. The grooved rollers may alternatively be one-way descending, the grooves angled down in the direction of web travel. Alternatively, the grooved rollers may be center grooved. Center grooved rollers have grooves on either side of the roller midpoint angled toward the midpoint.

Alternatively, the turning elements 400, 420 may be fixed with respect to the moving web 11. The turning elements 400, 420 may comprise a plenum, an air supply 430, and a plurality of orifices arranged on the periphery of the turning element 400, 420 in that portion of the periphery underlying the web 11. When the air supply is activated, air flows through the plenum, out of the orifices and supports the web 11 as it moves past the turning elements 400, 420. The air turning elements subject the web 11 to lower levels of drag forces than rolling turning elements do because the web 11 is traveling on a supporting cushion of air and the movement of the web 11 does not need to overcome the frictional resistance of a rolling turning element.

As the web 11 unwinds from the roll 10, it is routed to downstream equipment. It may be necessary to orient the plane of the web 11 to horizontal as described above. It may also be necessary to support the web 11 as it travels from the unwind station to the downstream equipment. The span of the web between supports will vary depending upon the properties of the web being processed and the demands of the process itself In one non-limiting embodiment, lightweight webs 11 must be supported in transit to prevent wrinkling, sagging, and edge curling of the web 11. Supporting the web 11 such that no open span of the web 11 exceeds three times the width of the web 11 will reduce the occurrence of these undesirable conditions. That is, for a web 11 of width w, the spacing between supports should not exceed 3w. More specifically, the spacing should not exceed 2w. Still more specifically, the spacing should not exceed 1w.

Wrinkling of the web 11, where a portion of the web 11 folds onto the web 11 itself, can result in unacceptable product when the converting equipment downstream processes the wrinkled web 11. Sagging between supports can lead to web 11 positioning errors and unacceptable product downstream. Edge curl, where the edges of the web 11 curl out of the web plane can be indicative of excess local web tension and can stretch the web 11 resulting in an unacceptable level of variation in the downstream product. In another embodiment processing stiffer webs, longer spans are possible.

The web 11 should be supported by lightweight rolling elements as described above to reduce the drag forces on the web 11. In another embodiment, the web 11 may be supported on air-cushioned elements as described above to minimize web 11 contact surfaces.

Figure 2:
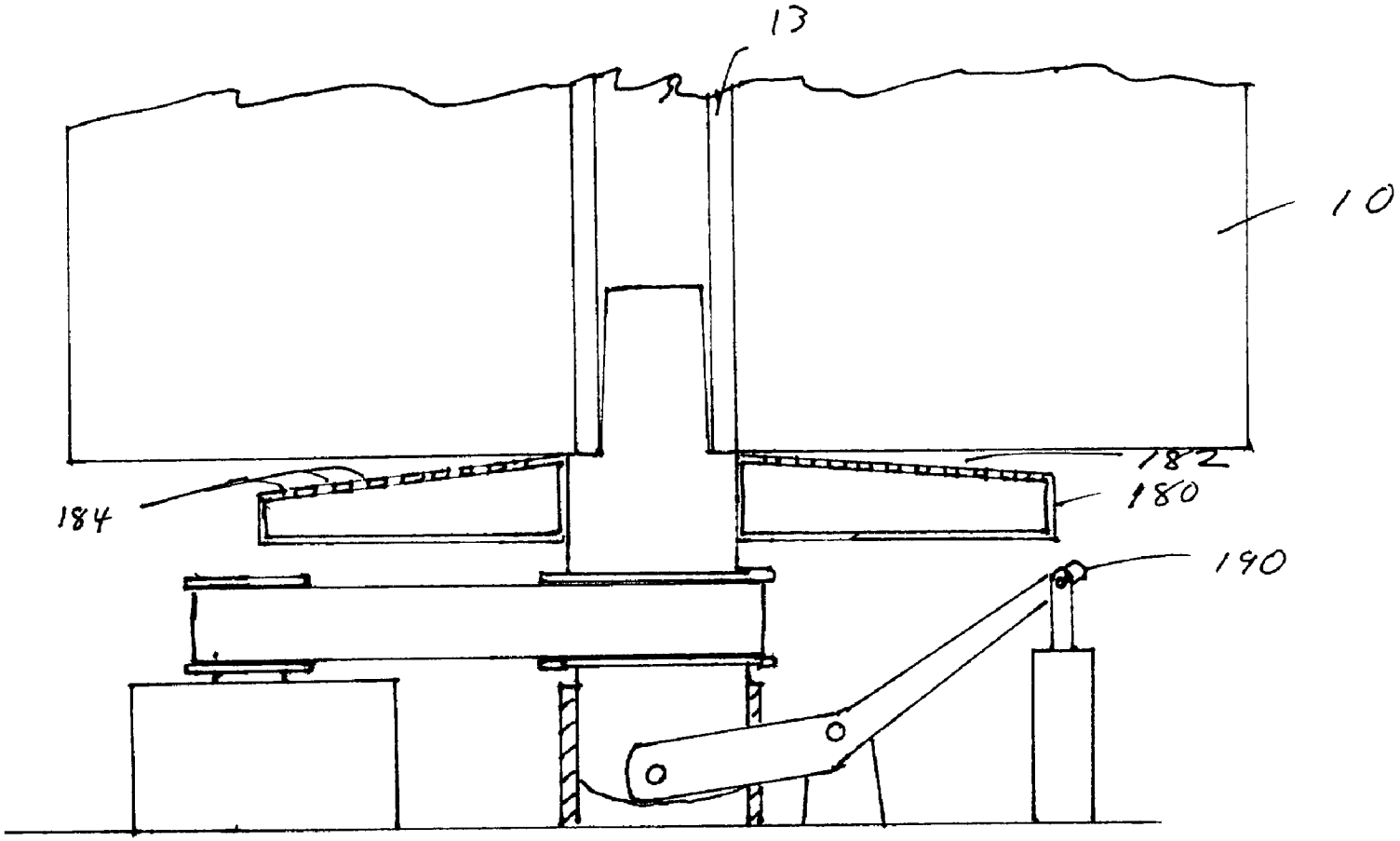
Figure 3B:
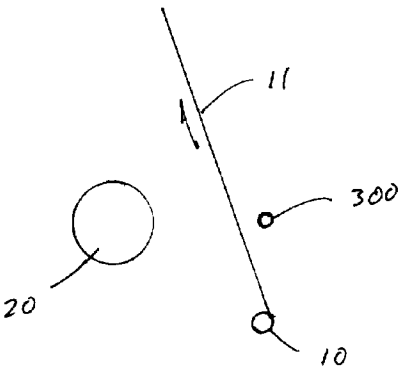
FIGS. 3*a*-3*d*, schematically show plan views of an apparatus according to the present invention for splicing multiple rolls of web material for continuous unwinding operations.
Figure 3D:
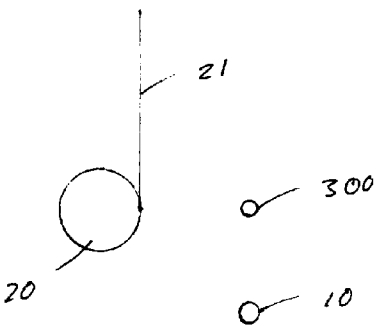
Figure 3A:
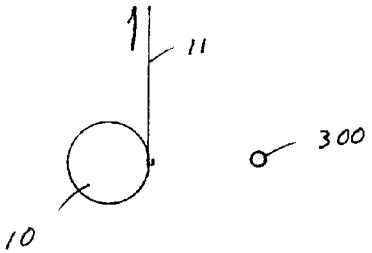
Figure 3C:
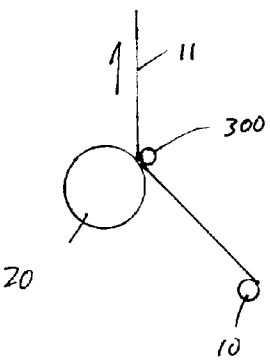

Roll Transport:

Vertically oriented rolls may be transported to the unwind station on a transport element 180 shown in FIG. 2, or without a transport element 180. Transporting the roll 10 on a transport element 180 reduces the possibility of damaging the roll 10 during transport since the transport equipment contacts the transport element 180 and not the roll 10 itself. The transport element 180 may be configured to support the entire lower surface of the roll 10 or a portion of the surface, or just the core 13 of the roll 10.

The transport element 180 may be adapted to rotate with the roll 10. In this embodiment the roll 10 may be at least partially driven by contact between the lower surface of the roll 10 and the rotating transport element 180. This contact surface advantageously provides a large, relatively non-compressible surface for driving the roll's rotation. The lower surface of the roll 10 is coupled to the transport element 180 by gravity and the friction between the web 11 and the transport element surface. The transport element 180 may be rotated by any means known in the art. As non-limiting examples, the transport element 180 may be driven by friction rollers, it may be belt driven, chain driven, gear driven or directly driven. In each case the controller controls the speed of the transport element 180.

The roll 10 may also be driven by contacting the circumferential surface of the roll 10 with either drive belts, or a friction roller. Multiple drive elements 100 in combination may be used to rotate the roll 10 as well. The roll 10 may be driven by contact between drive elements 100 and at least portions of the lower surface, upper surface, inner surface of the roll core 13, and the circumferential surface.

The apparatus may comprise a counterbalance element 190 illustrated in FIG. 2, adapted to offset at least a portion of the mass of the roll 10. The counterbalance element 190 may be comprised of a lever and fulcrum; a jackscrew; or other elevating means as known in the art. The counterbalance element 190 may be used to alter the distribution of the weight of the roll 10 on the support structure. The counterbalance element 190 elevates the core 13 of the roll 10 such that the roll no longer contacts the table. For rolls having sufficient core slippage force levels, and sufficient telescoping force levels, the support of the roll 10 can be focused on the core support 120 rather than on the roll support table.

Focusing the support of the roll 10 on the core support 120 reduces the pressure applied to any roll layer that is folded under on the lower surface of the roll 10. By offsetting the mass of the roll 10, the pressure on the folded layers may be reduced such that the fold will unwind without tearing the web 11.

Non-telescoping rolls may be transported and unwound on a transport element 180 having a stepped core support 120 or a convex upper surface 182, such that the transport element 180 contacts only the core 13 of the roll 10. The surface may be convex by as little as a few tenths of a millimeter, or as much as several centimeters (this amount being the difference in height measured from the edge of the element to the center of the transport element 180). A convex transport element 180 reduces the incidence of web tears resulting from imperfect windings on rolls 10. In some instances, the windings of rolls 10 are not completely parallel with one another. The edges of the windings may be folded over when the roll 10 is oriented vertically such that the inner windings rest on the folded portion. The weight of the inner windings can cause tearing in the web 11, as it is unwound. The inner windings of a roll 10 supported only by its core 13 and placed on a convex surface exert little if any weight on the folded windings and the folded layers may be unwound without tearing.

The transport element 180 may be adapted to support the roll 10 with a cushion of air. The transport element 180 may have an air plenum and a plurality of orifices 184 on the roll contacting surface. Air may be introduced into the air plenum through a rotary union coupled to the axis of rotation of the transport element 180. As the air exits the plurality of orifices 184, the roll 10 is lifted and supported on a cushion of escaping air. The air cushion allows folded portions of outer layers to freely unwind without tearing due to forces exerted by the inner layers.

The air plenum of the transport element 180 may be multi-chambered. The air supply may further comprise a manifold having discrete supply lines for each chamber and control valves in each supply line. As the roll 10 unwinds the orifices of the outer chambers will be uncovered. The air supply to the outer chambers may be reduced or completely turned off to reduce the amount of compressed air consumed.

The roll 10 may be rotated while the transport element 180 remains stationary. When reducing the speed of rotation of the roll 10, or stopping the rotation completely is desired, the air cushion may be removed by shutting off the air supply. This allows the roll 10 to settle on the surface and forces contact between the roll end surface and the surface of the element resulting in a braking force being exerted on the roll 10.

Method of Unwinding:

In one embodiment, the method includes the step of maintaining the tension in the web 11 at a desired tension. The desired tension is determined according to the physical properties of the web material. The desired tension for a tissue paper web 11 may be about 2 Newtons per lineal centimeter of web width. More specifically, the web tension may be maintained at less than 0.5 Newtons per lineal centimeter of web width, as the web 11 is unwound. Low web tensions (<2 N/cm) reduce the occurrence of web breakage when unwinding low-density tissue papers. These papers may be unwound at very low tensions (<0.5N/cm) to reduce the occurrence of wrinkling and edge curl in the web 11, as it is unwound.

The desired tension may be input to a controller by a process operator by means of a computerized operator interface, or alternatively, by means of a potentiometer, thumbwheel switch, or other input means as are known in the art. The actual tension may be monitored by wrapping the vertically oriented web 11 around a vertical roller adapted to facilitate the measurement of web tension. The roller has load cells incorporated into the roller end supports. Comptrol Tensioncell loadcells, model numbers BB30P12k, and BB30N12K available from Comptrol Inc., Cleveland, Ohio, are exemplary load cells suited to this purpose. The force on the roller due to web tension may be sensed and web tension calculated by a controller from the force and the geometry of the web wrap around the roller. The controller then compares the actual and desired web tensions determining the difference between the two as the web tension error. The controller may then adjust the speed of the web 11 to reduce the web tension error to zero.

Figure 4:
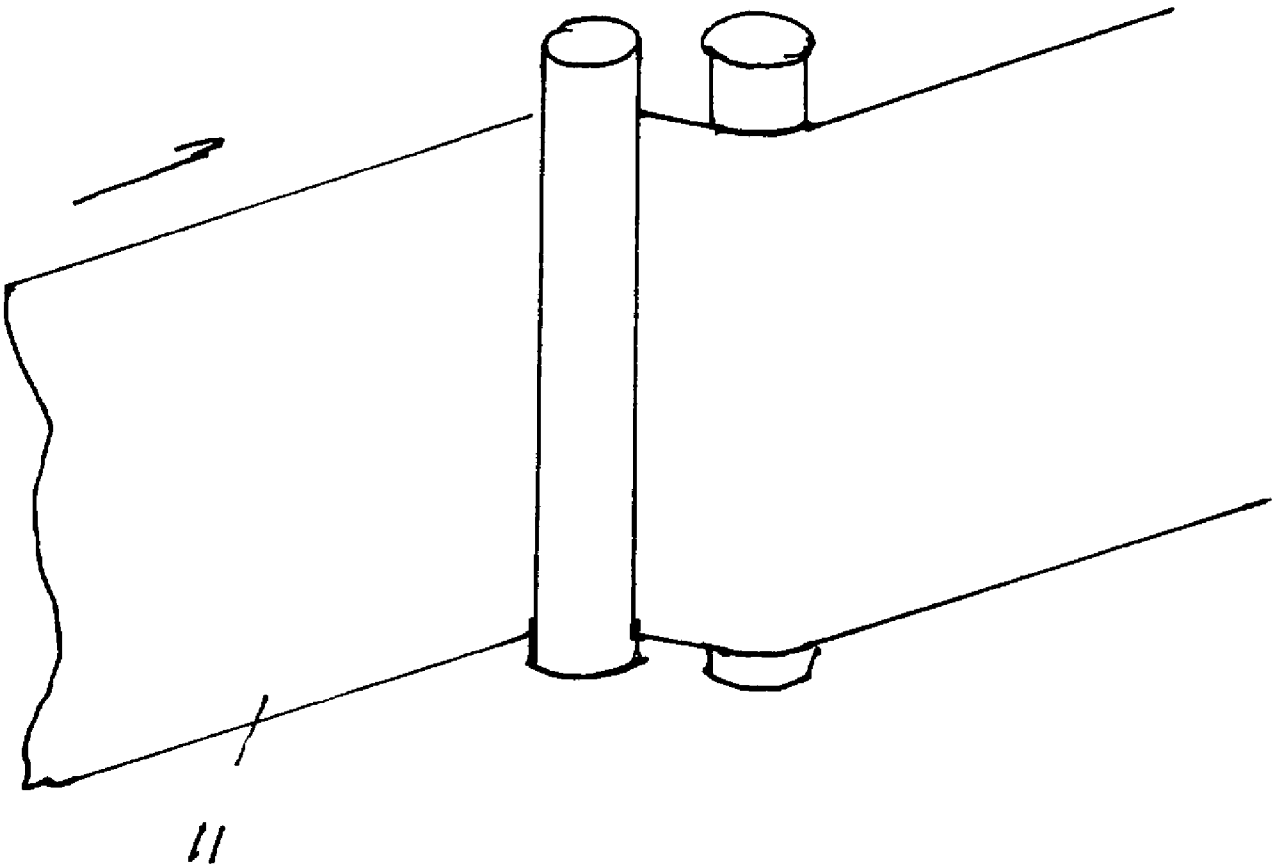
FIG. 4 schematically shows an s-wrap web drive.

The speed of the web 11 may be adjusted by adjusting the rotational speed of the drive element 100 or drive elements. Alternatively, the speed of the web 11 may be adjusted by adjusting the speed of an s-wrap drive element. An s-wrap drive element, illustrated in FIG. 4, comprises two vertically oriented rollers. At least one of the rollers is a powered roller. The web 11 is routed around the pair of rollers such that the rotation of the powered roller is imparted to the web 11 through the contact between the web and the roller. Adjusting the speed of the roller then adjusts the speed of the web.

The speed of the web 11 may be controlled to maintain a predetermined web speed. Controlling the speed of the web 11 comprises determining a desired speed of the web 11; determining the actual speed of the web 11; determining the difference between the desired and actual speeds as the web speed error; and adjusting the speed of the web 11 to reduce the web speed error to zero. Under normal operating conditions, the web speed may be maintained at a predetermined speed within acceptable control limits. A web speed of about 200 meters/minute may be maintained. More specifically, a web speed of 750 meters/minute may be maintained. Still more specifically, a web speed of 1000 meters/minute may be maintained. Web speeds in excess of 1600 meters/minute may be maintained depending upon the performance capabilities of the downstream equipment.

Web speed is a function of the rotational speed of the roll 10, and the circumference of the roll 10. Since the roll 10 circumference diminishes as the roll 10 unwinds, the rotational speed of the roll 10 must increase to maintain a constant web speed. The rotational speed increase may be made in discrete steps or may be continuously increased. Increasing the speed in steps will result in greater variation in the speed and tension of the web 11 since the speed changes will be discrete while the change in the circumference will be continuous.

Web speed is calculated using the speed of rotation of the roll 10 and the diameter of the roll 10 as inputs. In one embodiment the diameter is measured using a sensor as described above. The distance from the sensor to the edge of the roll 10 is measured, and the diameter is calculated. To reduce the affects of variations in the roll diameter, a rolling average of the distance measurement may be used for the calculation rather than a discrete measurement value. A rolling average is the average value of a set of time stamped measurement values. The average is considered rolling in that the oldest value in the set is dropped when a new value is added. The average is therefore always of the same number of values and always of the most recent values. The speed of rotation is measured as described above and the speed is then calculated as a function of the diameter of the roll 10 and the speed of rotation of the roll 10.

In another embodiment, the initial roll diameter is determined and input into the controller. The controller then calculates the change in the roll diameter using the ratio of the angular displacement of the unwind station to the angular displacement of a known diameter downstream roller. The speed of the web 11 is then calculated as a function of the calculated diameter of the roll 10 and the speed of rotation of the roll 10.

As noted above, the tension of the web 11 is in part a function of the speed differential between the unwind station and the downstream equipment. The tension may be controlled by rotating the unwind station at a progressively higher rate as the roll 10 unwinds to maintain a constant web speed, and varying the speed of the downstream equipment to maintain the proper level of web tension. Alternatively, the downstream equipment speed may be maintained at a constant desired level and the rotation of the roll 10 may be varied to maintain the desired speed and tension in the web 11. In another alternative the tension of the web 11 may be controlled using s-wrap rollers as described above.

The web 11 may also be unwound according to a desired web speed without regard to web tension. In this embodiment, the desired web speed is entered into the controller and the rotation of the roll 10 is controlled to achieve and maintain the desired speed. The desired speed may be a fixed value or may be derived according to the speed of the downstream equipment.

The rotation of the roll 10 may be continuous from its inception until the roll 10 is completely unwound. The rotation may be performed in an intermittent fashion, stopping and starting as the need of the downstream processes dictates. The terms continuous and intermittent refer to the intent regarding the unwinding of the web 11. Continuously unwinding therefore refers to an intent to unwind the web 11 from inception to completion, and intermittent refers to an intent to unwind the web 11 in predetermined sections, stopping the unwinding between sections. In both continuous and intermittent unwinding, the method allows for the cessation of the rotation in the event of a web 11 break during the unwinding process.

Splicing:

The unwinding apparatus of the present invention facilitates the splicing of one roll 10 to another. Splicing is defined as attaching the web 21 of a subsequent roll 20 to the web 11 of a previous roll 10 such that the web of the first and second rolls may be routed to the downstream equipment without a break in the web 11. Splicing may be performed while the webs are in motion (a flying splice) or while the webs are stopped.

Splicing rolls without stopping the process reduces the need to ramp down and ramp back up the speed of the process, and yields greater converting productivity. More time is utilized converting rolls to end products and less time is spent starting and stopping the process.

FIGS. 3*a*-3*d* illustrate one embodiment of an apparatus for splicing multiple rolls 10 of web material 11. In this embodiment, an operator prepares the second roll 20 by unwinding one or more layers of web 11 and cutting the leading edge in the shape of a "V", or the web 11 may be cut perpendicular to the machine direction. Perforated double-sided splicing tape is then applied to the second web 21. When a predetermined amount of web 11 remains on the first roll 10, the first roll 10 is translated to a new position upstream of the original unwind position. The second roll 20 is placed in the position vacated by the first roll 10. The second roll 20 is accelerated such that the speed of the web 21 at the outer circumference of the second roll 20 matches the unwinding speed of the first web 11. A pivoting splice roll 300 moves the first web 11 into contact with the rotating second roll 20. When the splicing tape on the leading edge of the second web 21, contacts the first web 11, the two webs become attached to each other and the second web 21 begins to unwind. The first web 11 is then either cut with a cutoff bar (not shown) or broken by slowing the rotation of the first roll 10. In one non-limiting embodiment, the web is broken by a combination of using a cutoff bar and braking the rotation of the first roll 10. The double-sided splicing tape may alternatively be placed on the second web 21 at a point distant from the leading edge of the web 21.

In another embodiment, the first web 11 may be accumulated in a festoon system as is known in the art by unwinding the first web 11 at a web speed greater than the speed of the downstream process. When a sufficient amount of the first web 11 is accumulated in the festoon, the first roll 10 may be stopped, the first and second webs joined as described above, the remainder of the first web 11 separated from the joined webs, and the second roll 20 rotated to unwind the second web 21.

Alternatively, the web 11 may be spliced by preparing the second web 21 for splicing as described above, then stopping the first roll 10, joining the first and second webs as described above, separating the first web 11, and starting the rotation of the second roll 20.

Multiple Plies:

The apparatus of the present invention may be adapted to facilitate the concurrent unwinding of multiple webs. These multiple webs may then be converted into multi-ply paper products having at least two plies. For each ply desired in a finished product, two unwind stations and splicing apparatus are provided to allow for flying splices as the converting process proceeds. The apparatus for each ply may also comprise a force measuring support roll, web supports as necessary, an angled element, and subsequent horizontal element, to orient the web 11 of each ply to a horizontal plane. The apparatus for the multiple plies may be disposed side by side at a single elevation, or the apparatus may be disposed at multiple elevations. Multiple elevation apparatus may be stacked one above another to facilitate the converting process and/or to reduce the overall floor space requirements.

A single controller may be used to monitor the tension in multiple webs and to adjust the rotation of the multiple rolls 10 accordingly. Alternatively, individual controllers may be used for the rolls of each ply.

The orientation of the "wire side" of the paper plies in the finished product may be controlled by the geometry of the turning elements. The wire side of each ply will have the same orientation as the webs unwind. Each web 11 is reoriented by routing the web 11 from vertical with the direction of movement parallel to the floor; to vertical with the direction of movement perpendicular to the floor; to horizontal with the direction of movement parallel to the floor. Routing one web 11 perpendicular to, and moving toward, the floor and the other web 11 perpendicular to, and moving away from, the floor, the wire side of each web 11 may be configured as the outer surface of a two ply product. In another embodiment, the wire sides may be configured as the inner surfaces of a two-ply product. In another embodiment, the wire side of a first ply could be configured in a face-to-face relationship with the fabric side of a second ply.

What is claimed is:

1. A method of unwinding a vertically oriented roll of web material convolutely wound about a core, the roll having an upper surface, a lower surface and a circumferential surface, the method comprising steps of:

a) supporting at least a portion of the core with a core support;

b) determining a desired web tension;

c) unwinding the vertically oriented roll of web material at an unwind speed;

d) measuring an actual web tension;

e) calculating a web tension error by comparing the desired web tension and the actual web tension; and, f) adjusting the unwind speed of the web according to the web tension error by adjusting a rotational speed of the core support.

2. The method according to claim 1, comprising a step of driving at least a portion of at least one surface of the roll.

3. The method according to claim 1, comprising a step of stabilizing an upper end of the roll.

4. The method according to claim 1, wherein the step of rotating the vertically oriented roll comprises intermittently rotating the roll.

5. The method according to claim 1, wherein the step of rotating the vertically oriented roll comprises continuously rotating the roll.

6. The method according to claim 1, comprising a step of unwinding the web at a web speed of at least 200 m/minute.

7. The method according to claim 1, comprising a step of reorienting the web to a horizontal plane.

8. The method according to claim 7, comprising a step of routing the web around an air bar.

9. The method according to claim 1, comprising a step of supporting the vertically oriented web such that the web has no unsupported span longer than twice the width of the web.

10. The method according to claim 1, comprising a step of supporting at least a portion of the lower surface of the roll.

11. The method according to claim 10, comprising a step of supporting the roll on an air cushion.

12. The method according to claim 1, comprising a step of concurrently rotating the transport element and the roll.

13. The method according to claim 1, comprising a step of routing the web to downstream equipment adapted for converting the web.

* * * * *